United States Patent [19]

Focke

[11] Patent Number: 5,074,096

[45] Date of Patent: Dec. 24, 1991

[54] PRODUCTION PLANT FOR PRODUCING LARGE UNITS IN THE FORM OF BOARDED BUNDLES OF GROUPS OF SMALL PACKS OF PAPER TISSUES INCLUDING A RESERVOIR UNIT FOR TEMPORARILY STORING THE SMALL PACKS DURING A MALFUNCTION OF THE PLANT

[75] Inventor: Heinz Focke, Verden, Fed. Rep. of Germany

[73] Assignee: Focke & Co., (GmbH & Co.), Verden, Fed. Rep. of Germany

[21] Appl. No.: 531,358

[22] Filed: May 31, 1990

[30] Foreign Application Priority Data

Jun. 24, 1989 [DE] Fed. Rep. of Germany ..... 3920749
Dec. 6, 1989 [JP] Japan ..... 3940296

[51] Int. Cl.[5] ..... B65B 13/00; B65B 61/18; B65G 1/00; B65G 37/00

[52] U.S. Cl. ..... 53/133.5; 53/202; 53/531; 198/347.3

[58] Field of Search ..... 53/53, 133.5, 202, 147, 53/438, 531; 198/347.3

[56] References Cited

U.S. PATENT DOCUMENTS

| | | | |
|---|---|---|---|
| 3,360,100 | 12/1967 | Seragnoli | 198/347.3 |
| 3,499,555 | 3/1970 | Wahle | 198/347.3 |
| 3,939,984 | 2/1976 | Butner et al. | 53/53 X |
| 4,149,545 | 4/1979 | Hall | 198/347.3 X |
| 4,220,236 | 9/1980 | Blidung et al. | 198/347.3 |
| 4,499,987 | 2/1985 | Long | 198/347.3 |
| 4,539,795 | 9/1985 | Wilkinson | 53/202 X |
| 4,560,057 | 12/1985 | Applegate et al. | 198/347.3 X |
| 4,819,407 | 4/1989 | Focke et al. | 53/202 |
| 4,830,170 | 5/1989 | Focke | 198/347.3 |
| 4,840,007 | 6/1989 | Focke et al. | 53/202 X |
| 4,845,924 | 7/1989 | Focke et al. | 53/438 |

FOREIGN PATENT DOCUMENTS

| | | |
|---|---|---|
| 1275441 | 8/1968 | Fed. Rep. of Germany . |
| 1586087 | 3/1970 | Fed. Rep. of Germany . |
| 2022602 | 11/1970 | Fed. Rep. of Germany . |
| 1925751 | 10/1971 | Fed. Rep. of Germany . |
| 3347552 | 7/1985 | Fed. Rep. of Germany . |
| 3230533 | 4/1987 | Fed. Rep. of Germany . |
| 2097744 | 11/1982 | United Kingdom . |

*Primary Examiner*—Horance M. Culver
*Attorney, Agent, or Firm*—Sughrue, Mion, Zinn Macpeak & Seas

[57] ABSTRACT

In the event of a fault in an individual machine of a production plant for producing large units in the form of boarded bundles of groups of small packs of paper tissues which comprises a folding machine for producing paper tissues and grouping these into stacks, a packing machine for enwrapping the stacks with a foil for forming a small pack, a stacker for forming groups of small packs, a bundle machine for enwrapping the groups with a foil for forming a bundle and a cartoning machine for inserting the bundles into a carton and for closing the same for forming large units, the further operation of the other individual machines of the production plant is quaranteed by incorporating a reservoir unit behind the packing machine with respect to the direction of production for receiving and temporarily storing small packs and for transferring small packs back into the production plant when required.

15 Claims, 12 Drawing Sheets

PRODUCTION PLANT FOR PRODUCING LARGE UNITS IN THE FORM OF BOARDED BUNDLES OF GROUPS OF SMALL PACKS OF PAPER TISSUES INCLUDING A RESERVOIR UNIT FOR TEMPORARILY STORING THE SMALL PACKS DURING A MALFUNCTION OF THE PLANT

BACKGROUND OF THE INVENTION

The invention relates to a production plant for producing large units in the form of boarded bundles of groups of small packs of paper tissues.

Large units are understood to be cartons used for transport, storage and sale and which contain a plurality of bundles. Bundles are understood to be units, enwrapped by a foil or the like, of several groups of small packs, while small packs are understood to be the conventional paper tissue packs with 10 paper tissues. Since paper tissues are a typical mass-produced article, very fast running production plants are needed which consist of a plurality of individual machines being disposed in succession with respect to the paper tissue production and being in operative relationship. If a single machine of such a production plant is temporarily out of action, the whole plant ceases to operate. Failure of operation of a single machine is not necessarily due to a defect but can also be caused by a flow pile-up in the region of the machine concerned. Although such a pile-up can be cleared relatively fast by service personnel, it nevertheless necessitates not only a shutdown of the respective individual machine, but of the a whole production plant as well. Due to the high production speed, however, even a short interruption involves a relatively high loss of production. Moreover, the fast running production plants which are affected can only be slowly accelerated to their full production speed after every standstill so that the loss of production resulting from a shutdown of the production plant is higher than would actually be expected.

SUMMARY OF THE INVENTION

The object of the invention is therefore to construct a production plant of the above-described species such that in the event of an individual machine being out of action, the production is able to continue if it is in any way possible at least in parts of the production plant, so that other machines which are, depending on the type of the broken-down machine, upstream or downstream of the respective machine, do not have to be stopped.

According to the invention, a reservoir unit is provided behind (i.e. immediately downstream of) the packing machine so that if there are any defects or pile-ups in one of the machines downstream of said packing machine, it is possible to keep the packing machine and the preceding folding machine running, as in the event of this kind of failure, the small packs coming out of the packing machine can be fed into the reservoir unit where they are temporarily stored. On the other hand it is also possible to keep the machines downstream of the packing machine or the reservoir unit in operation in the event of any faults upstream of said reservoir unit. In this case, the machines downstream of the reservoir unit can be supplied with small packs from the reservoir unit until the fault in the upstream machines is cleared.

It is not possible to incorporate the reservoir unit in the production plant for instance in front of the packing machine, since at this point of production the folded paper tissues are only stacked in appropriate groups but not yet enwrapped, which makes them impossible to handle as regards feeding them into a reservoir unit.

If the defect is not directly behind the reservoir unit, i.e. in the stacker for forming pack groups of small packs, but even further downstream in direction of the production, all the machines behind the reservoir unit and in front of the place of defect have to be temporarily shut down, which would make it look advisable to dispose one reservoir unit between every two successive machines of the production plant, thus necessitating a very high investment expenditure. If, however the reservoir unit is disposed directly behind the packing machine as proposed by the invention, all the machines following downstream are those which can be accelerated practically immediately to full production speed after a standstill, since only the machines upstream of the reservoir unit need to be accelerated slowly. Hence, the arrangement of the reservoir unit directly behind the packing machine as defined by the invention represents a near enough absolutely optimal solution of the problem of preventing the loss of production in the event of a fault in one of the machines of the production plant.

Evidently, the embodiment according to the invention also serves for production plants having on the whole practically two internal production lines, for example with double or multi-track side-by-side operation in the folding machine and the other machines. In this case the reservoir unit has to be formed correspondingly with two or several tracks. In this connection it does not matter if the multiple parallel production lines merge together, for example in the last machine of the production plant, in order to uniformly make one large unit each out of the incoming units.

The basic design of the reservoir unit, in the form of a circular band led over deflecting rollers and having carriers, can be modified such that a portion of the circular band is arranged vertically or nearly vertically with an allocated pushing apparatus of the reservoir unit being arranged at the beginning of this portion, while at the same time guaranteeing small overall dimensions, at least in the direction of production of the production plant, so that such a reservoir unit can be incorporated into already existing production plants.

Depending on the design of the carriers of the circular band, small packs can only be temporarily stored thereon, if the free ends of the carriers do not point downwards directly or at an angle. In order to increase the storage capacity it is therefore advisable to have a horizontally extending further portion following the nearly vertically a extending portion of the circular band.

If the carriers of the circular band are not designed as smooth members, but have some kind of projections at their free ends, it is possible to provide a further portion following the nearly or exactly vertical first portion via a deflecting roller. In order to save space, this second portion is also led vertically such that it extends downwardly from the end of the first portion. If the carriers are provided with such projections, however, the small packs to be stored have to be lifted over these projections when being pushed in the reservoir by means of the pushing devices. Instead of providing the carriers with projections, it is therefore advisable with the above-described arrangement of circular band portions to arrange the carriers on the band so close together that the space between two successive carriers forms a pocket being adapted to the size of the small packs. Thus, the small packs are secured by being wedged between two carriers. so that there is no risk of a small pack being in the reservoir unit getting lost along the path of the downwardly directed band portion or at any other point.

In order to facilitate the insertion of the small packs into such pockets, it is advisable to provide a supporting roller in the region of the pushing devices at the rear side of the circular band, said roller also having a deflecting function with respect to the preceding and the following deflecting roller. The offset arrangement of this supporting roller causes the pocket formed between two carriers of the circular band to open out in the region of the pushing devices which facilitates the insertion of the small packs. Since the pockets likewise open when the circular band is running backwards, the temporarily stored small packs can easily be extracted from the pockets. By providing pockets it is also possible to let the circular band circulate completely, even if all pockets are filled with a small pack, without the risk of the small packs falling out of the reservoir unit. There is even the possibility to drive the circular band only in one direction for both, insertion and extraction of the small packs to and from the reservoir unit.

In order to obtain a storage capacity of the reservoir unit as high as possible and a relatively slow movement of the circular band, it is advisable to arrange several carriers side-by-side on the circular band, so that for instance with five carriers arranged next to one another, five small packs can be stored or discharged from the reservoir at a time. In view of relatively long lasting failures, a large storage capacity of the reservoir unit is highly recommendable. A high number of carriers should be arranged next to one another on the circular band, so that the reservoir unit can operate at low circular speed, that is at long cycles for each transfer process.

By designing the circular band such that it consists of a plurality of slat-like members arranged in succession in moving direction having one carrier each, possible repair work on the circular band can be done swiftly by replacing individual members or carriers without having to completely replace the whole circular band with all carriers which would take a lot of time. Moreover, this embodiment guarantees a quick changeover to slightly smaller or thinner small packs by replacing the carriers with thinner or thicker carriers.

In order to affix a greater number of carriers side-by-side on the circular band it is advisable to design the band in the form of two parallel spaced out partial bands, the carriers being affixable on both partial bands by means of a cross-piece. Moreover, two partial bands prevent the carriers from tilting to the side or inclining with the risk of losing the small packs during the fast and at times possibly jerky operation of the reservoir unit.

For ensuring a trouble-free transfer of the small packs to the carriers of the reservoir unit, it is advisable to provide a pickup table within the reservoir unit, specifically for picking up the delivered small packs. This pickup table should have slits being transverse to the transport direction of the small packs for the pushing device to pass through. The slits are offset relative to the carriers with respect to the transport direction of the production plant to such an extent, that the individual pushers of the pushing device can be led past the carriers when pushing small packs onto said carriers or taking them from these. The number of jointly movable pushers should correspond to the number of carriers arranged side-by-side on the circular band. Since modern paper tissues packs are not only provided with tear-open strips or the like but also with reclosable opening means, it is advisable to provide a tapeapplicating unit downstream behind the reservoir unit, by means of which tapes are affixed to the packs with which the opened pack can be reclosed again and which can also function as gripping means for the first tear-open of the pack.

BRIEF DESCRIPTION OF THE DRAWINGS

Further details of the invention are described below with reference to the drawings which show.

DETAILED DESCRIPTION OF PREFERRED EMBODIMENTS

Figure 1:
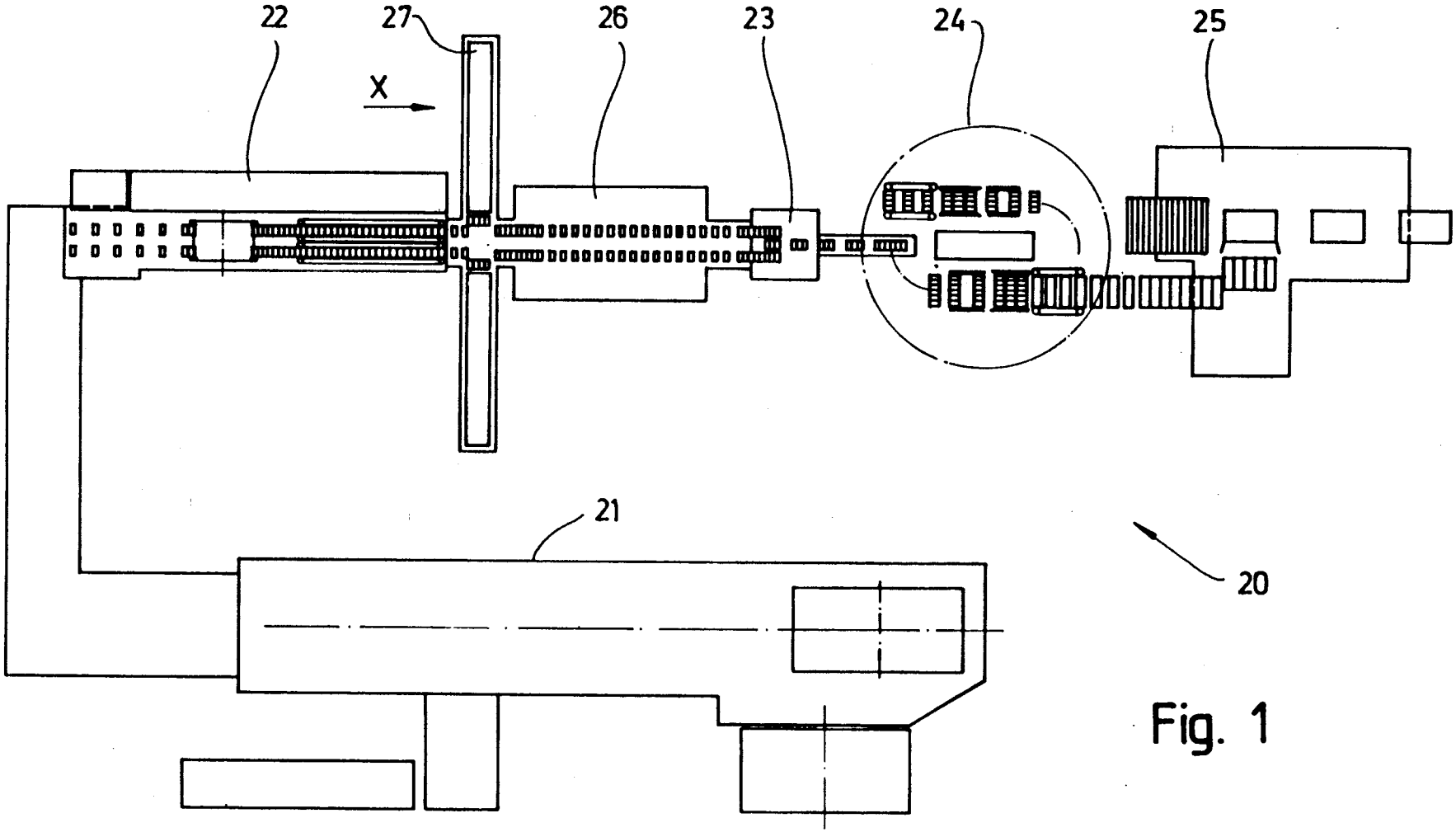
FIG. 1 a schematic plan view of a production plant according to the invention.

According to FIG. 1 the production plant 20 as defined by the invention consists of a folding machine 21 for producing the paper tissues and grouping these into stacks, downstream thereof a packing machine 22 for enwrapping the paper tissue stacks with a foil for forming small tissue packs 32, downstream thereof a stacker 23 for forming pack groups of finished small packs 32, downstream thereof a bundle machine 24 for enwrapping the pack groups with a foil for forming a bundle and finally a cartoning machine 125 disposed at the end of the production plant for inserting the bundles into cartons and closing the cartons.

Additionally, a tape-applying unit 26 is disposed in front of (upstream of) the stacker 23 for affixing a tape to the small packs 32 which have been finished beforehand, said tape serving on the one hand as a tear-open flap for the small packs 32 and on the other hand also as a means for reclosing a pack once it has been opened.

According to the invention, a reservoir unit 27 is incorporated into the production plant (consisting of individual machines 21 to 25 and optionally 26) behind or downstream of the packing machine 22.

FIG. 1 shows that the folding machine 21 produces paper tissues or tissue stacks on two tracks running next to one another. The packing machine 22 and the tape-applying unit 26 also operate with two parallel tracks and finally the small packs 32 of both tracks are jointly formed into groups of small packs 32 in the entrance region of the stacker 23. In the following part of the production plant 20, i.e. in the bundle machine 24 and the cartoning machine 25 there is only one single operating track.

Figure 2:
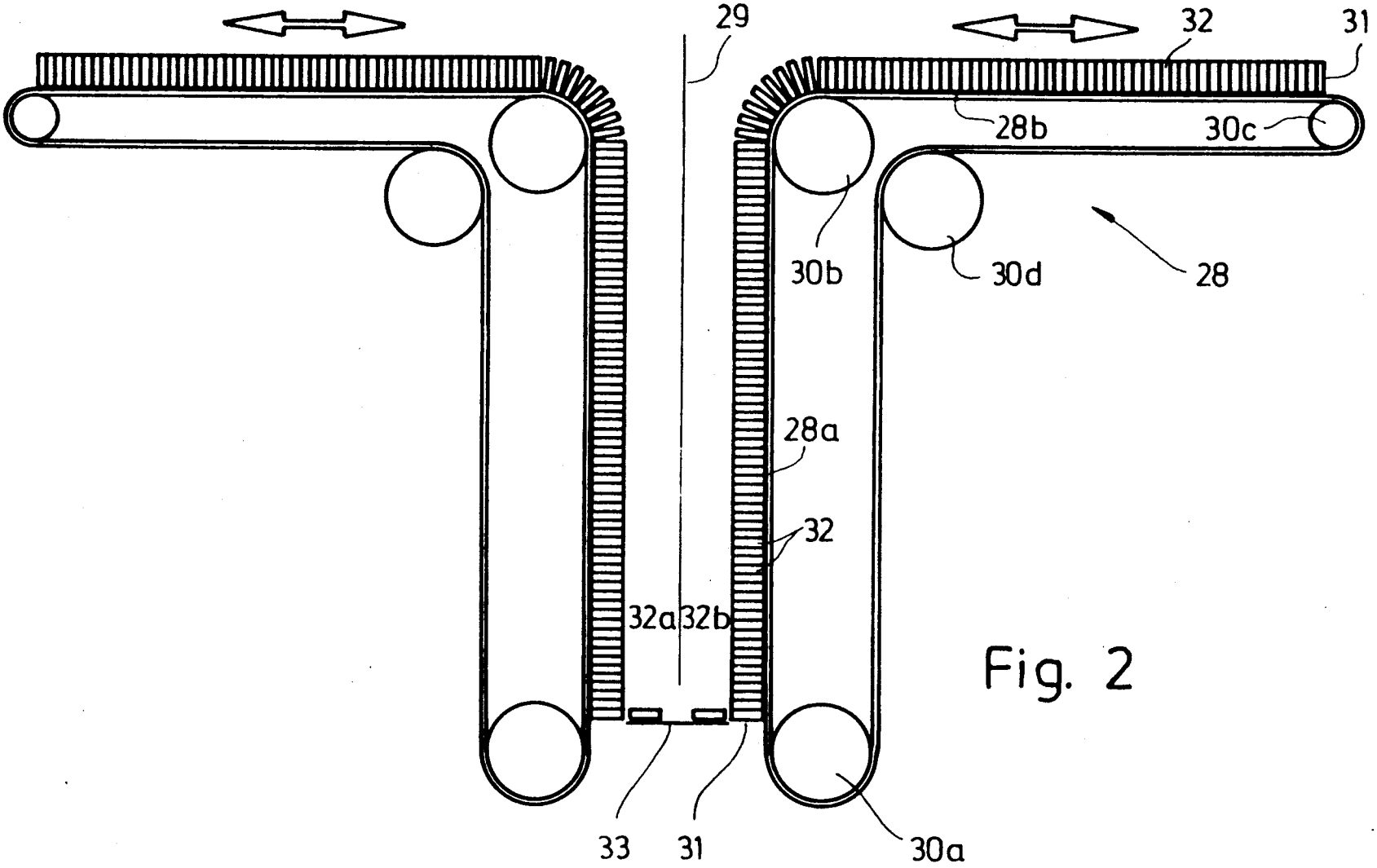
FIG. 2 a schematic view of a first embodiment of the reservoir unit of FIG. 1 seen from the direction of arrow X of FIG. 1, FIG. 3 a similar view of a second embodiment of the reservoir unit, FIG. 4 a detail of FIG. 3 on a larger scale, FIG. 5 another detail on a larger scale, FIG. 6 the detail of FIG. 5 with different position of the pusher, FIGS. 7 perspective views of a detail of the reservoir to 11 unit in the region of the transfer from the pickup table to the circular band at different stages of the transfer process and FIG. 12 the detail of FIGS. 7 to 11 without representation of the feed and discharge band for the small packs but including representation of a supporting roller for the circular band which also has a deflecting function.
Figure 3:
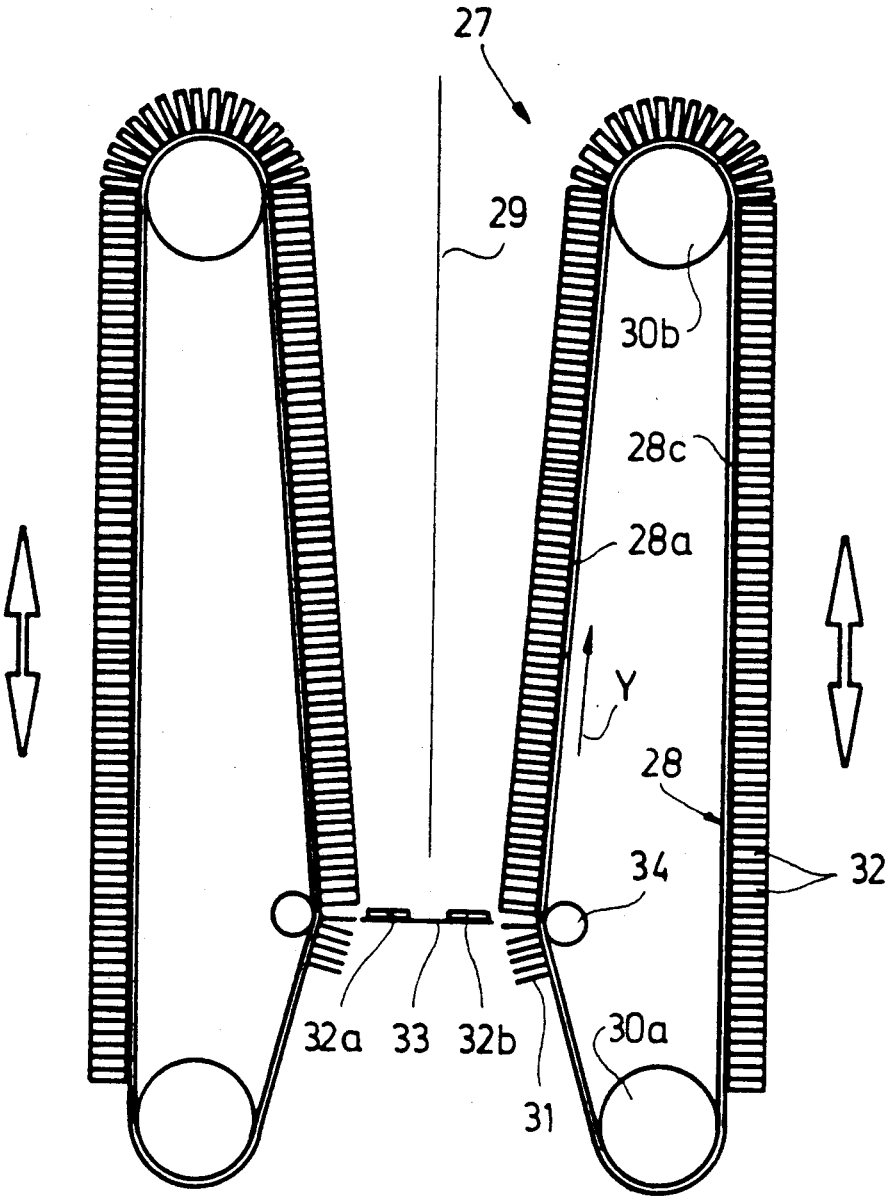

In accordance with the two-track operation of the production plant at least in the first part of the plant, the reservoir unit 27 is also designed for two-track operation as is clearly shown by FIGS. 2 and 3.

FIG. 2 shows a substantial portion of a first embodiment of the, reservoir unit 27 in a view from the direction of arrow X (FIG. 1). The circular band 28 and the twin design of the reservoir unit 27 with respect to the two-track operation of the production plant 20 are also shown by this figure. Since the reservoir unit 27 is formed in mirror symmetry relative to the vertical plane 29, it will be sufficient to describe for instance only the right part of the reservoir unit 27.

The circular band 28 is led over altogether four deflecting rollers 30*a* to 30*d*. Said circular band 28 is provided with a plurality of carriers 31 in direct succession, between which a respective number of small packs 32 is already held. Since the carriers 31 of the embodiment of FIG. 2 are merely carriers projecting from the plane of the circular band 28, the small packs 32 can only be taken over by the carriers 31 in the region of the first vertically extending portion 28*a* of the circular band 28 and the adjoining horizontal portion 28*b* of the circular band 28. The only reason for not showing any carriers 31 in the region of the other portions of the circular band 28 is to simplify the representation. Because of the shown particular position of the deflecting roller 30*d* , the circular band 28 can not be provided with carriers 31 along its complete length. This would be possible, however, if the deflecting roller 30*d* was arranged such that it contacted the circular band 28 on the same side as the deflecting rollers 30*a*, 30*b* and 30*c*.

FIG. 2 furthermore schematically outlines in the region of the deflecting roller 30*a* the pickup table 33 with two small packs 32*a* and 32*b* lying side-by-side, one small pack belonging to one track and the other small pack belonging to the other track of the production plant 20. The pickup table 33 serves for receiving the small packs 32 from the preceding packing machine 22 and also for transferring the small packs 32 to the downstream stacker 23, and furthermore for transferring the small packs 32 to the reservoir unit 27 or for receiving the small packs 32 from said reservoir unit 27.

The representation of FIG. 3 is of the same type as that of FIG. 2 and shows a different embodiment of the reservoir unit 27, the circular band 28 being provided with carriers 31 along its entire length. In the lower part of the drawing, however, the carriers are not shown. Just like in FIG. 2 the shown carriers already hold small packs 32.

The nearly vertically disposed first portion 28*a* of the circular band 28 is followed by a further vertical band portion 28*c* behind the upper deflecting roller 30*b*. With respect to arrow Y indicating the conveying direction of the circular band 28, this band portion 28*c* is moving downwardly. Again, two small packs 32*a* and 32*b* are shown to be lying side-by-side on the pickup table 33. A supporting roller 34 is disposed in the region of said pickup table 33 at the rear side of the circular band 28. The offset arrangement of the supporting roller 34 relative to the runoff region of the deflecting roller 30*a* and the run-up region of the deflecting roller 30*b* effects the supporting roller 34 to have a deflecting function at the same time by spreading the carriers 31 being in that particular region, as can be seen especially in the enlarged representation of FIG. 4.

Figure 4:
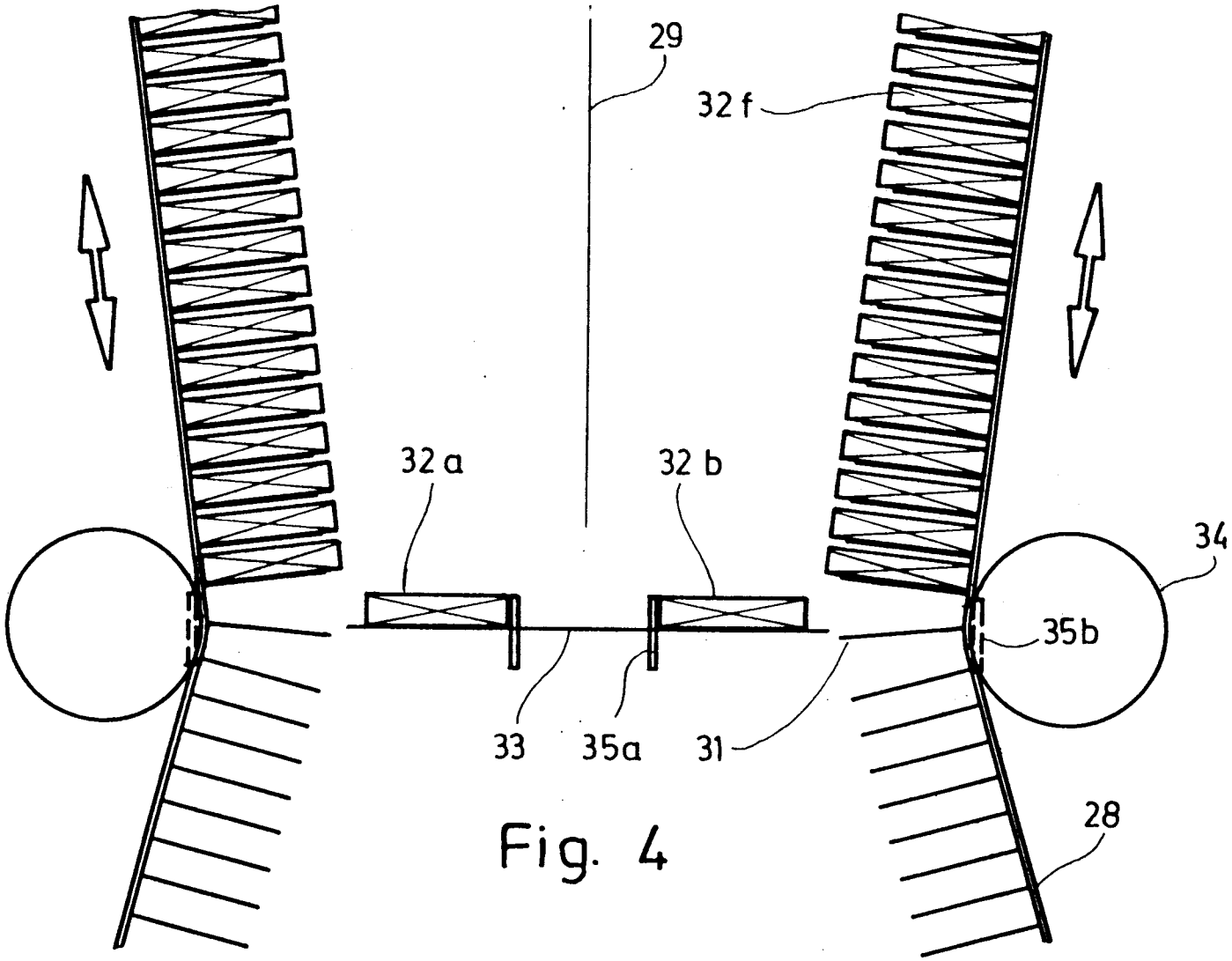

FIG. 4 shows in the upper region of the drawing a plurality of small packs 32*f* which have already been taken over by the circular band 28, the respective carriers 31, however, not all being shown. The carriers 31 in the lower part of the drawing of FIG. 4 do not yet contain temporarily stored small packs 32.

Furthermore, FIG. 4 shows the outlines of the pushing device in the form of an in-line pusher 35*a* and an out-line pusher 35*b*, the former serving for pushing the small packs from the pickup table 33 onto the carriers 31 and the latter serving for pushing the small packs from the carriers 31 onto the pickup table 33.

Figure 5:
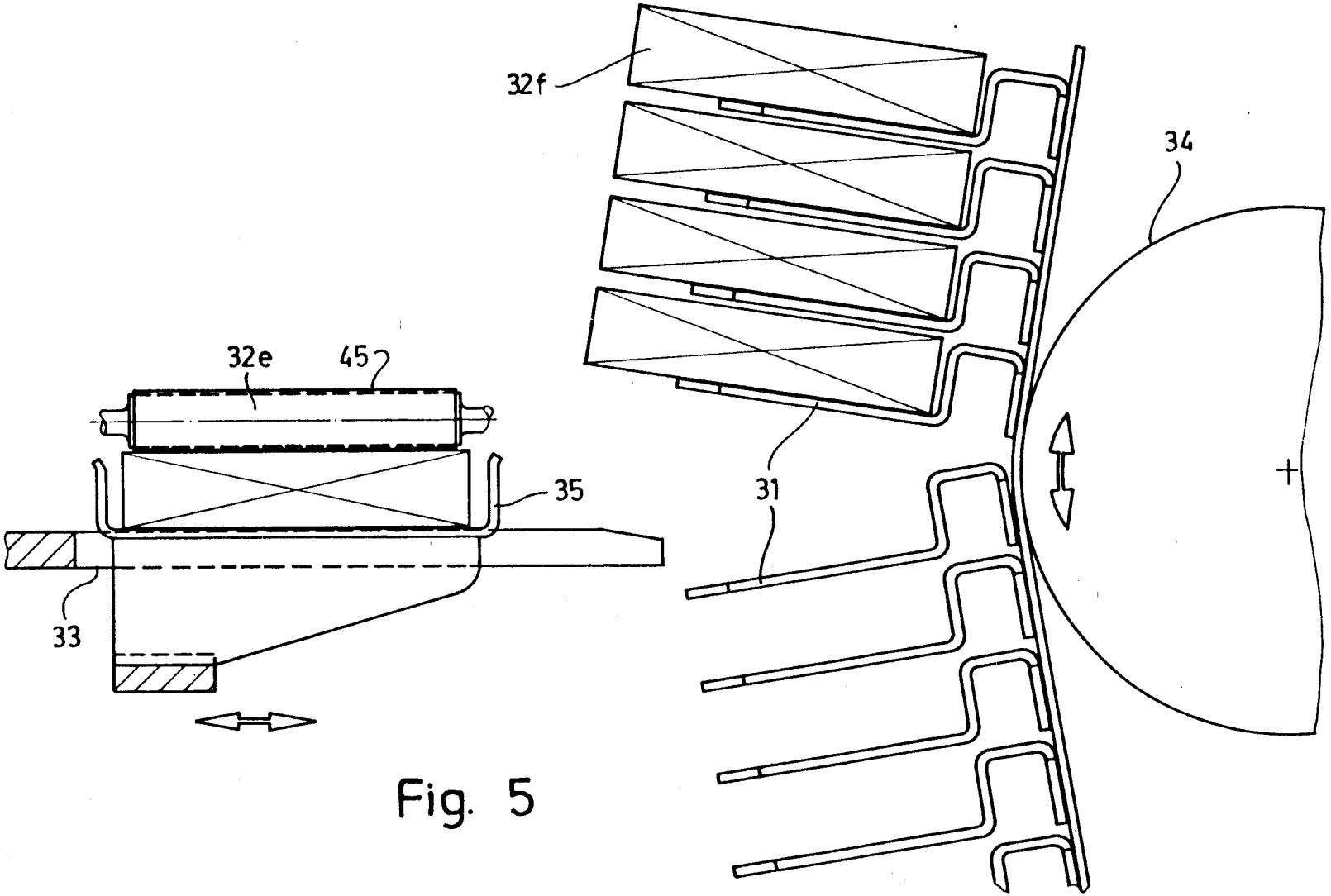
Figure 6:
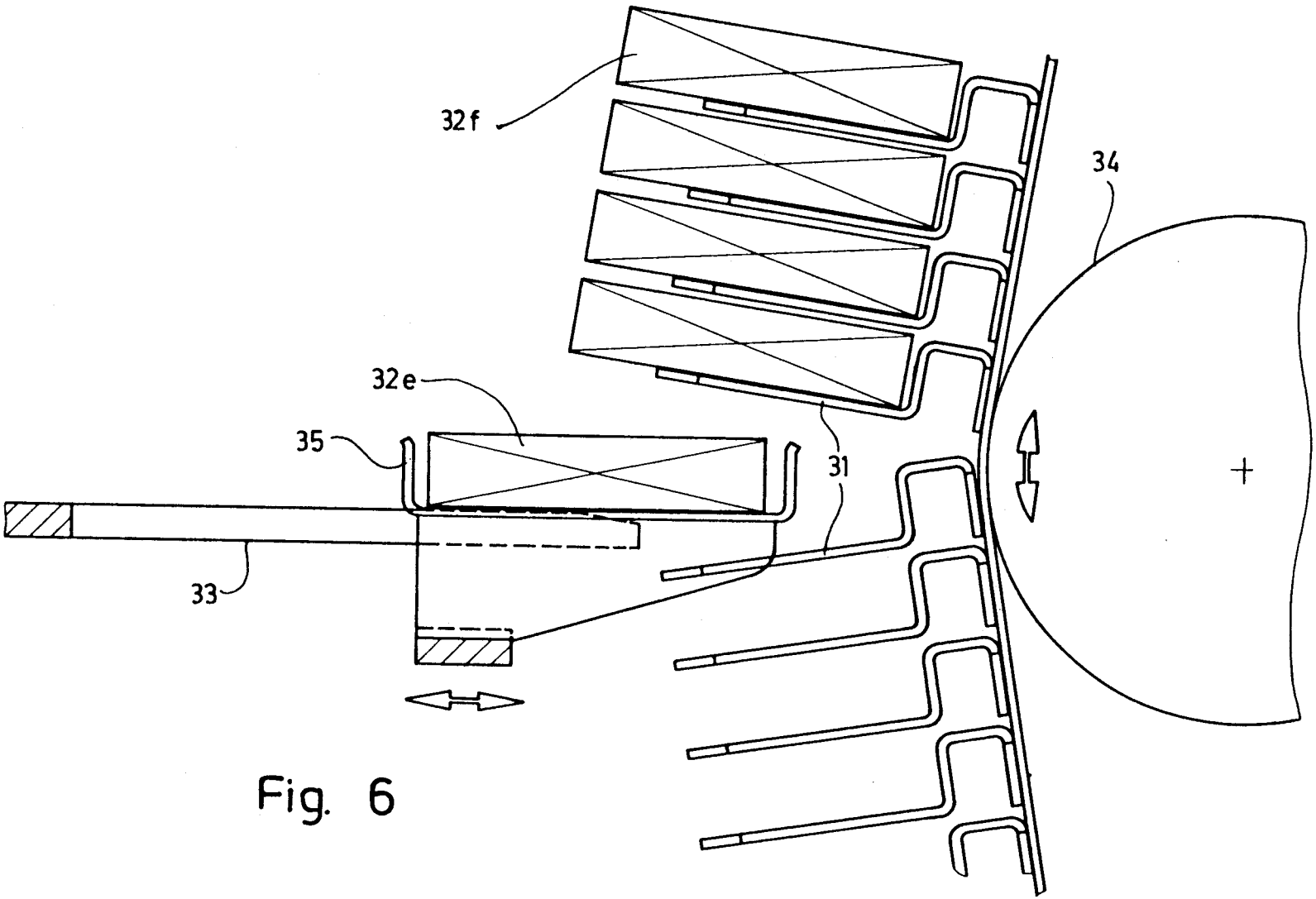

FIGS. 5 and 6 show particularly clear how the carriers 31 spread when the circular band 28 is running over the supporting roller 34 which also serves as a deflecting roller. In these figures, however, the carriers 31 are only shown in a row one behind the other without the circular band 28, on which said carriers 31 are arranged.

According to FIGS. 5 and 6, a single pushing device 35 serves for pushing the small packs onto the carriers 31 and back from these onto the pickup table 33. The small packs can be moved in the one as well as the other direction by means of this pushing device. Hence, the shown pushing device 35 performs the functions of the pushing-in device 35*a* and the pushing-out device 35*b* of FIG. 4.

Due to the carriers 32 being spread as a result of the circular band 28 running over the supporting roller 34, the insertion of the small packs with the pushing device 35 is facilitated, since the aperture angle of the space between two carriers 31 widens. This spreading of adjacent carriers 31 also facilitates the transfer of the small packs from the carriers 31 back onto the pickup table 33.

As can be clearly seen in FIGS. 5 and 6, the space between two adjacent carriers 31 is dimensioned such that small packs are practically wedged inbetween the carriers 31 when taken over by these. Furthermore, both figures reveal the possibility of forming the circular band 28 out of slat-like members such that these members substantially correspond to the thickness of a small pack and the thickness of a carrier 31, so that one slat-like member is assigned to each carrier 31, as will be described in more detail further below in connection with FIG. 12. In FIG. 5 the pushing device 35 is still completely in the region of the pickup table 33 and in FIG. 6 it is already pushed forward in direction of the circular band 28. This in-pushing process goes from the position of FIG. 5 via the one of FIG. 6 as far in the direction of the circular band 28 as needed for the carriers 31 to be able to safely take over the small packs.

FIG. 5 shows a further detail, namely an upper belt 45. This belt is arranged above the pickup table 33 and can be lowered onto or lifted off the small packs 32*e* lying on said pickup table. The purpose of the upper belt 45 is to convey the small packs 32*d*, 32*e* and 32*g* on the pickup table 33, if this should not be ensured by the thrust of the following small packs. The upper belt 45 particularly conveys small packs 32*g* which are transferred back by the pushing device 35 to the discharge conveyor 37. In order to make the drawings less complicated, the upper belt 45 is only shown in FIG. 5 and not in the further FIGS. 6 or 7 to 11.

The detail representations of FIGS. 7 to 11 show the transfer of small packs from the pickup table 33 to the circular band 28 at different stages and the passage of small packs 32*c* reaching the pickup table after transport by a feed conveyor 36 from the upstream packing machine 22 and further transport of the small packs 32*g* from said pickup table via a discharge conveyor 37 in direction of the downstream tape-applicating unit 26. The small packs being still on the feed conveyor 36 and not yet in the pickup region of the pickup table 33 have been denoted by numeral 32*c*, 32*d* is the numeral for those small packs which are in the pick-up region of the pickup table 33, i.e. which are ready for being transferred to the reservoir unit 27 or which have just been transferred back from this unit. 32*e* denotes those small packs which are just being transferred to the reservoir unit 27 or transferred back from this unit, while 32*f* denotes those small packs which have already been received by the reservoir unit 27. 32*g* on the other hand denotes those small packs which are already on the discharge conveyor 37 or which are, although still being on the pick-up table 33, not in the transfer region any more.

Figure 7:
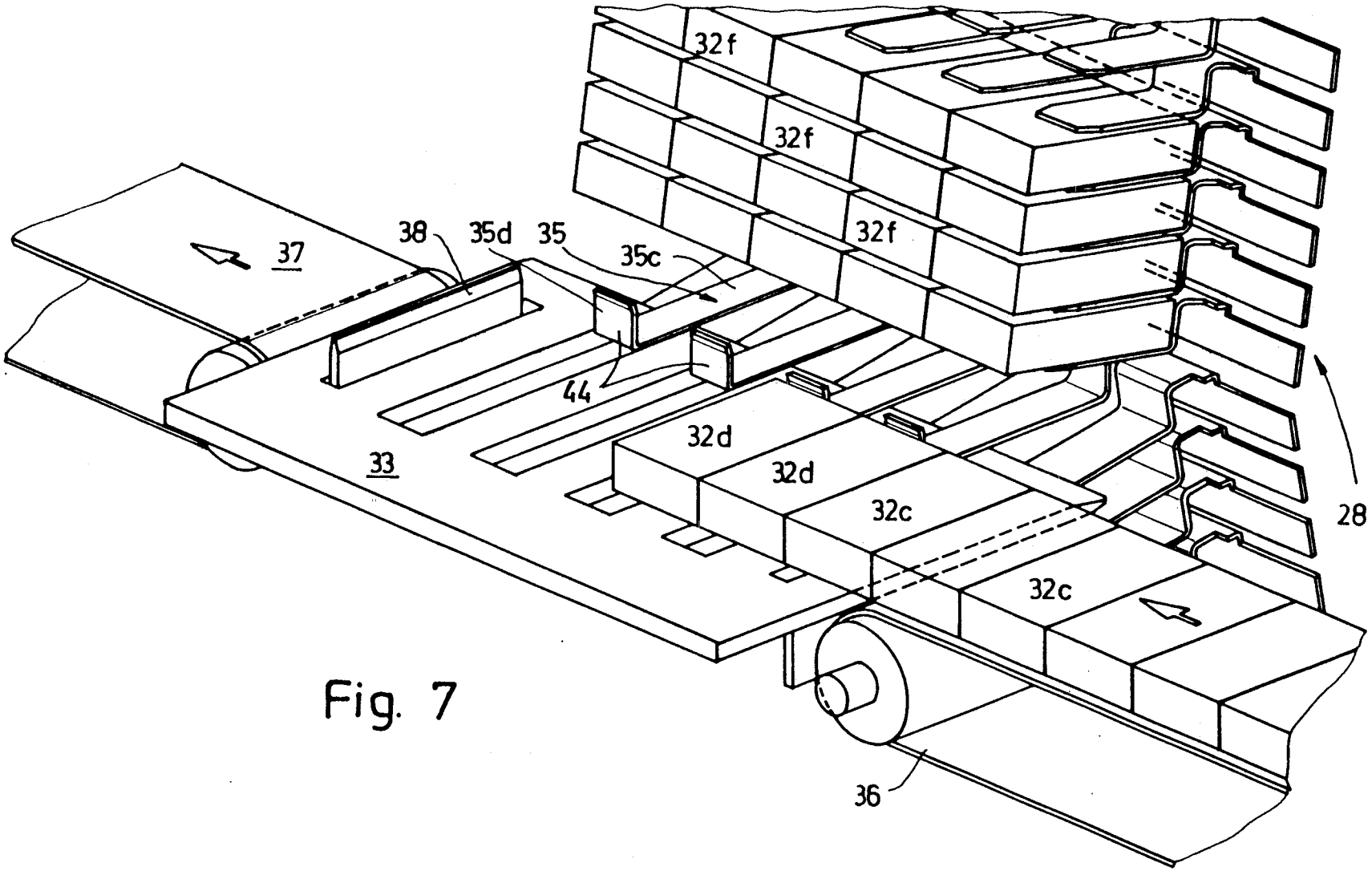
Figure 8:
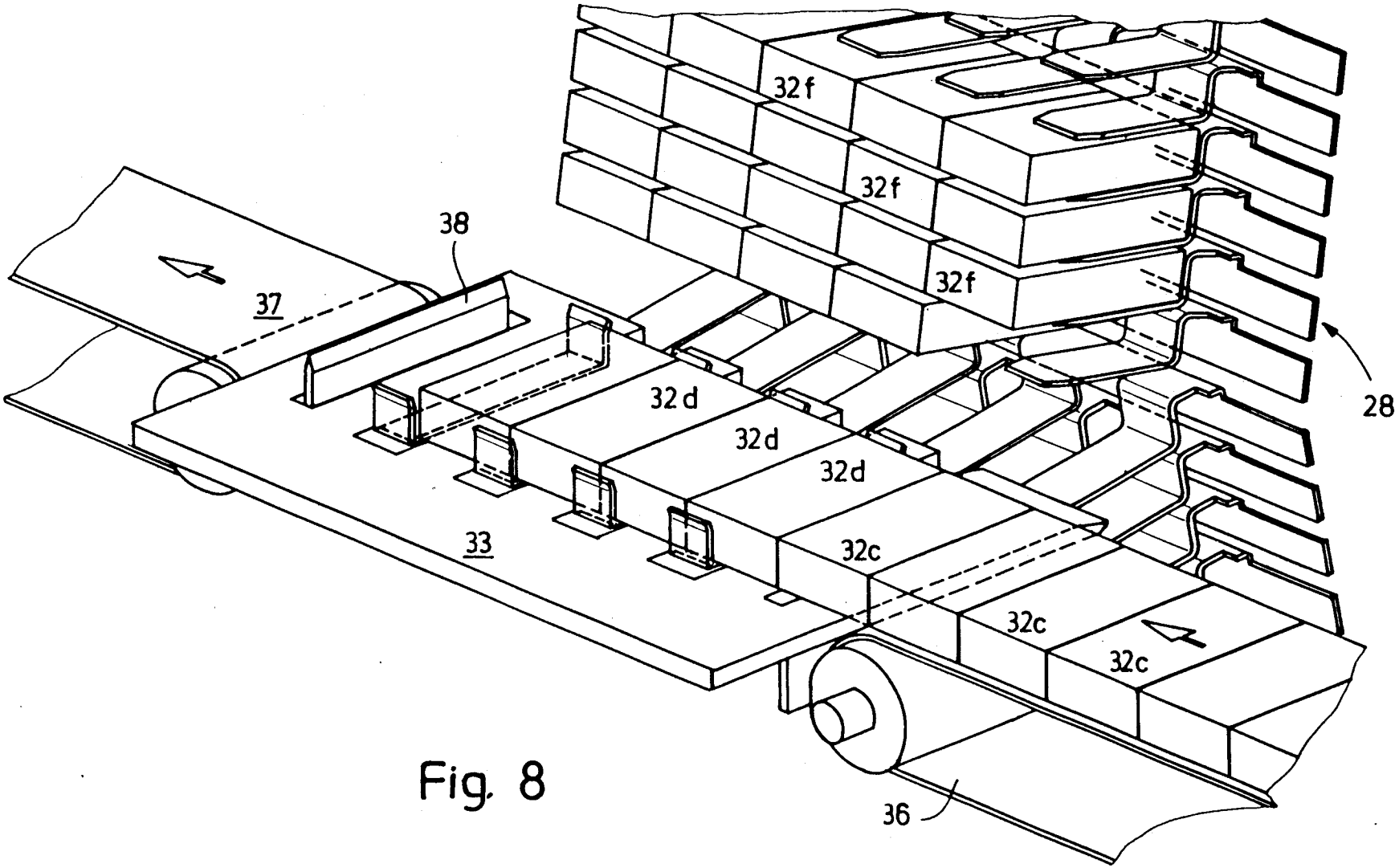
Figure 9:
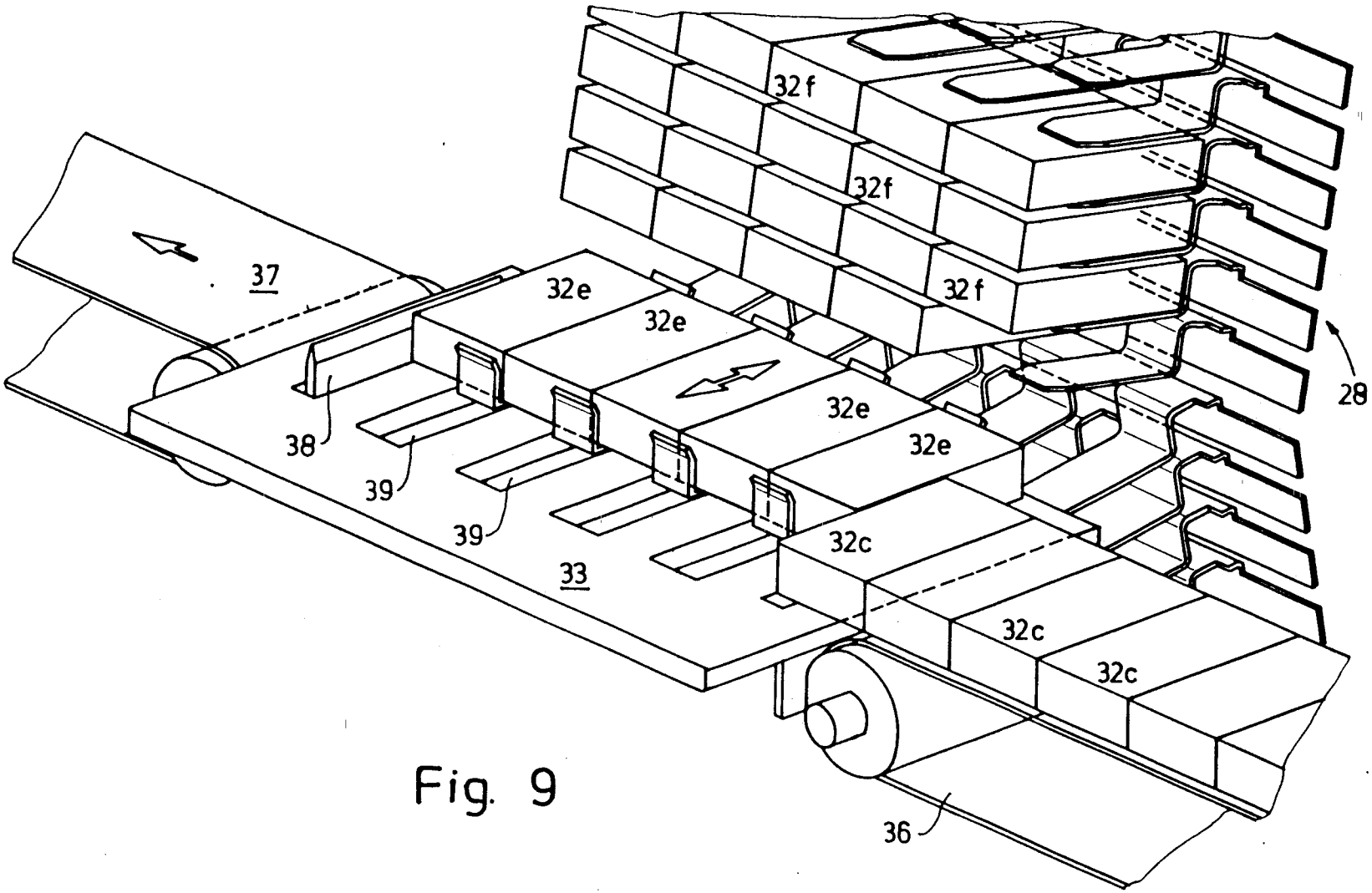
Figure 10:
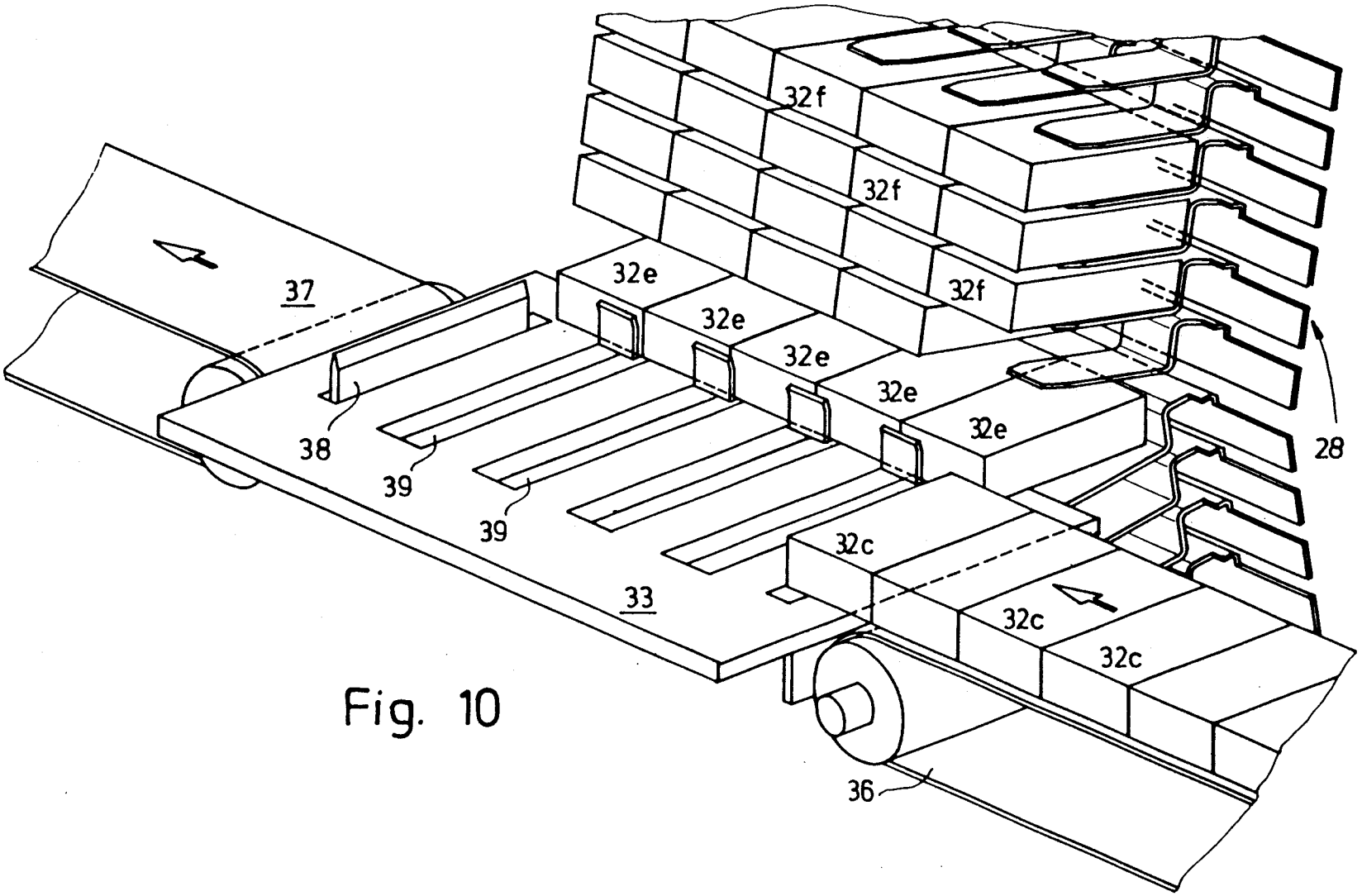

As shown in FIG. 7, the small packs 32*c* are delivered with the feed conveyor 36. These small packs move up against a retractable stop 38 which upwardly juts out from below through the pickup plane of the pickup table 33. This stop 38 is arranged such that exactly five small packs 32*d* come to lie in the pickup region of the pickup table 33 which corresponds to an arrangement of five parallel side-by-side carriers 31 on the circular band.

If there is no defect in one of the individual machines downstream of the reservoir unit 27, the small packs 32*c* delivered by the feed conveyor 36 run across and past the pickup table 33, i.e. the stop 38 is not upwardly projecting from the pickup plane of the pickup table 33, so that the delivered small packs can be further transported as small packs 32*g* by means of the discharge conveyor 37.

If, on the other hand, there is a defect in one of the individual machines downstream of the reservoir unit 27, the stop 38 is caused to move upwards above the pickup plane of the pickup table 33, thus moving into a stop-position. The five small packs 32*d* coming to lie in front of the stop 38 are engaged by the pushing device 35 and after passing intermediate positions shown in FIGS. 9 and 10 where the small packs are denoted 32*e* they are finally temporarily stored on carriers 31 and therewith on the circular band 28.

Like the stop 38, the pushing device 35 can also be moved upwards from below through slits 39 in the pickup table 33, so that it can contact the bottom side of the small packs 32*d* with its base surface 35*c* and, with an appropriate laterally directed movement, can finally take the small packs 32*d* with the upright edge pieces 35*d* of the pushing device 35 from the region of the pickup table 33 away and into the space between two successive carriers 31.

Figure 11:
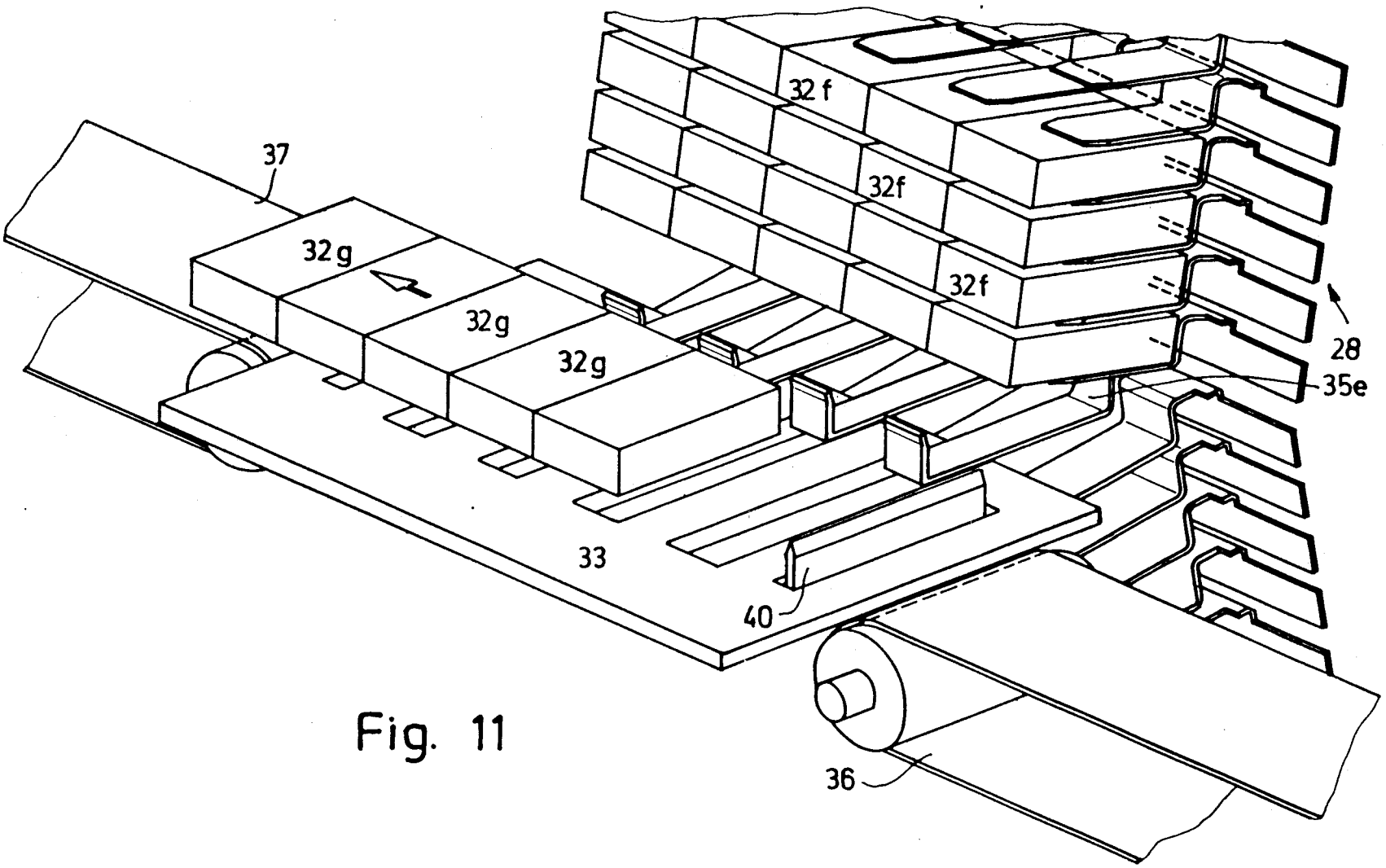

In analogy to stop 38, a further stop 40 is disposed at the entrance of the pickup table 33 which is clearly shown by FIG. 11. This stop 40 prevents a further delivery of small packs 32*c* into the transfer region of the pickup table 33 as long as there are small packs 32*d* still being inserted into the spaces between the carriers 31 or transferred back from there to the transfer region of the pickup table 33. Said stop 40 has the particular function of ensuring that no small packs 32*c* delivered on the feed band 36 can get into the transfer region of the pickup table 33 when small packs 32*f* temporarily stored by the reservoir unit 27 are transferred back to the transfer region of the pickup table 33.

In analogy to the upright edge pieces 35*d* of the pushing device 35, corresponding upright edge pieces 35*e* are provided at the other end for the purpose of this back-transfer.

Figure 12:
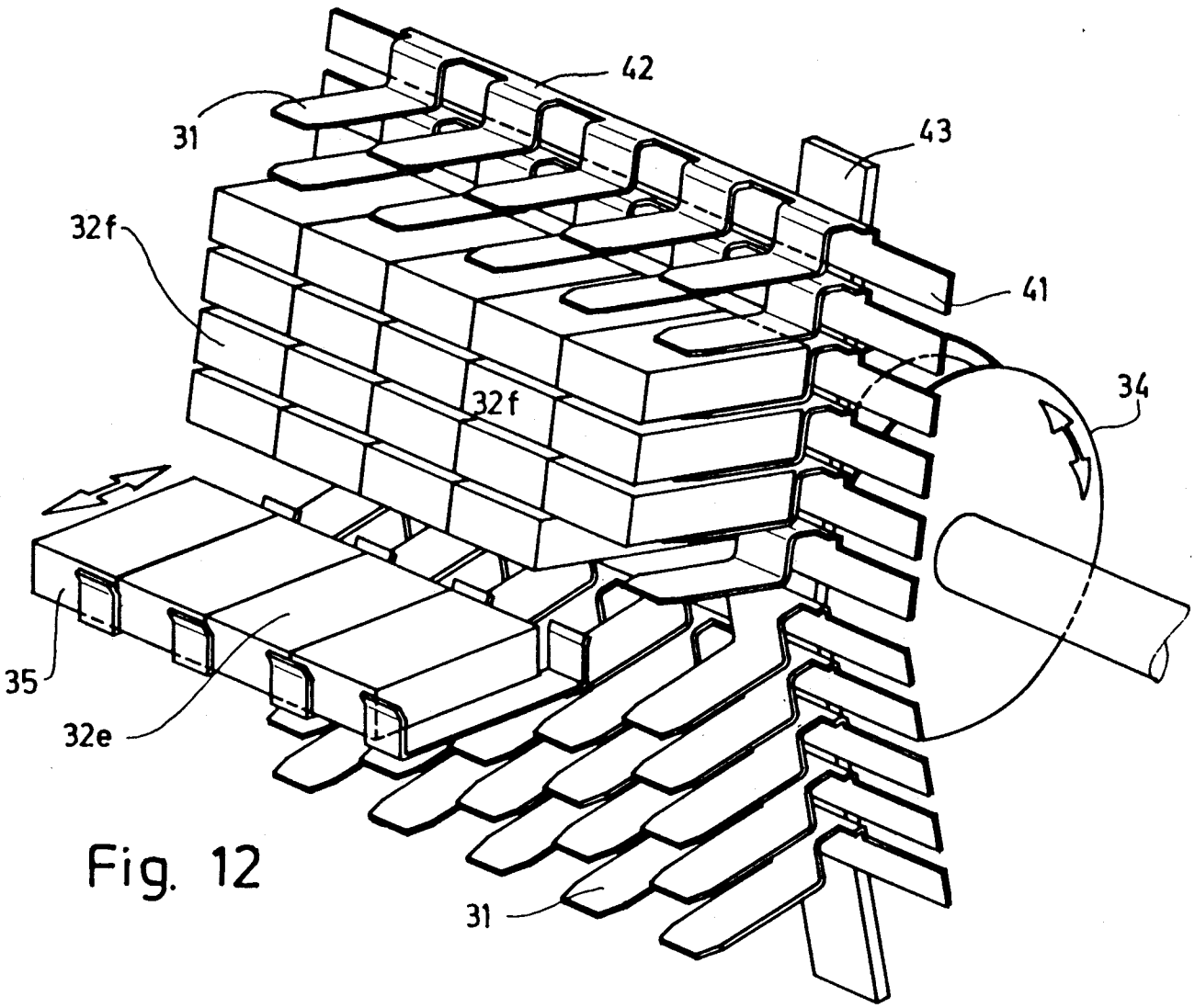

FIGS. 7 to 11 and also FIG. 12 reveal the formation of the circular band 28 out of a plurality of slat-like members 41. Each of these members 41 supports a plurality of carriers 31. These carriers 31 are connected to one another and to a slat-like member 41 via a cross-piece 42. With respect to the moving direction of the circular band, the slat-like members 41 are spaced apart such that the space between two successive carriers 31 in the moving direction corresponds to the thickness of a small pack, i.e. such that this space forms a pocket for wedging in a small pack.

In order to facilitate the insertion of a small pack into such a pocket, said pockets can be spread open so that their aperture angle widens. For this reason the circular band 28 consisting of slat-like members 41 is led over the supporting roller 34 (FIG. 12) which also possesses a certain deflecting function.

To ensure stability of the carriers 31 mounted on the circular band 28, it is advisable to construct the circular band 28 in the form of two parallel running partial bands. FIG. 12 illustrates such an embodiment, but only shows the one partial band 43.

The pushing device 35 for transferring the small packs 32 from the pickup table 33 to the carriers 31 and vice versa can consist of a plurality of individual pushing members 44. All of these pushing members which are for instance shown by FIG. 7, should be jointly operable. There should be as many pushing members 44 as there are carriers 31 side-by-side on the circular band 28. Such a design of the pushing device 35 with a plurality of pushing members makes it possible to form the pickup table 33 with slits 39, so that there is a relatively complete continuous closed surface of the pickup table 33 which is of advantage for the further movement of the small packs 32 across the table surface. It is furthermore advisable as regards this movement of the small packs 32 on the table plane, that the pushing device 35, regardless of how it is constructed in detail, is only lowered down so far, that the top face of the base surface 35*c* lies exactly in the plane of the top face of the pickup table 33, when said pushing device is inactive. i.e. when small packs 32 are moved across the surface of the pickup table 33.

What is claimed is:

1. In a production plant for producing, along a production line, large units in the form of boarded of groups of small packs of paper tissues, said plant including a folding machine for producing the paper tissues and for grouping the tissues into stacks, downstream of said folding machine a packing machine for enwrapping each of the paper tissue stacks with a foil for forming a paper tissue small pack, downstream of said packing machine a stacker machine for forming pack groups of small packs, downstream of said stacker machine a bundle machine for enwrapping each of the pack groups with a foil for forming a bundle, and downstream of said bundle machine a cartoning machine for inserting a plurality of bundles into a carton and for closing the carton in order to form transportable and storable large units, all of said aforementioned machines being in operative relationship, the improvement comprising:

reservoir means (27), disposed between the packing machine (22) and said stacker machine (23) and immediately downstream of said packing machine (22), operable for receiving and temporarily storing small packs (32) during a temporary halt or reduction in operation of any following said machines located downstream of said packing machine (22), and for transferring stored small packs (32) back into the production line of the event of a reduction in operation of said packing machine (22); and means for feeding said small packs (32) in two parallel rows from said folding machine (21), to said packing machine (22), to said reservoir means (27) and to said stacker machine (23);

wherein said reservoir means (27) comprises two separate part reservoirs (28*a*, 28*b*, 28*c*) which are respectively associated with said two parallel rows of said small packs (32) and which are operable independently of one another.

2. The production plant according to claim 1, wherein said reservoir means (27) consists of a circular band (28) led over deflecting rollers (30*a* to 30*d*) and having carriers (31), with one portion (28*a*) of said circular band (28) extending at least approximately vertically and with a pushing device (35; 35*a*, 35*b*) being disposed at the beginning of said band portion (28*a*) for pushing small packs (32) in and out onto and off said carriers (31).

3. The production plant according to claim 2, wherein a separate pushing device (35*a*, 35*b*) each is provided for pushing the small packs (32) in and for pushing said packs out.

4. The production plant according to claim 3, wherein a supporting roller (34) is arranged in the region of each pushing-in and pushing-out device (35; 35*a*, 35*b*) at the rear side of said circular band (28).

5. The production plant according to claim 4, wherein the deflecting rollers (30*a* or 30*b*) for said circular band (28) preceding and following said supporting roller (34) are arranged such that said circular band (28) is also deflected when it runs over said supporting roller (34).

6. The production plant according to claim 5, wherein said carriers (31) of said circular band (28) are arranged so close in succession, that the space between two adjacent carriers (31) forms a pocket for a small pack (32), in which the small pack (32) can be held by being wedged in.

7. The production plant according to claim 6, wherein said circular band (28) consists of a plurality of slat-like members (41) following one another in the moving direction, said slat-like members (41) having assigned to them a carrier (31) each, the dimension of said slat-like members (41) in the moving direction corresponding to the thickness of a carrier (31) plus the thickness of a small pack (32).

8. The production plant according to claim 7, wherein for simultaneously receiving several small packs (32), a corresponding number of carriers (31) is arranged side-by-side relative to the conveying direction of said circular band (28).

9. The production plant according to claim 8, wherein each circular band (28) consists of two spaced out partial bands (43) arranged parallel to one another and wherein each carrier (31) is affixed to both partial bands (43) via a cross-piece (42).

10. The production plant according to claim 9, wherein said reservoir means (27) comprises a pickup table (33) for the small packs (32) delivered from the upstream packing machine (22), which has slits (39) being transverse to the transport direction of the small packs (32) through which said pushing device (35; 35*a*, 35*b*) can be moved upwards from below and then to the side or from the side in direction of the center of said pickup table (33) and then down, herewith taking along the small packs (32) lying on the pickup table (33) in the affected region for transferring said packs to said carriers (31) of said circular band (31) or taking along the small packs lying on the affected carriers (31) for transferring small packs to the pickup table (33).

11. The production plant according to claim 10, wherein said pushing device (35) has as many jointly movable individual pushing members (44) as there are carriers (31) disposed next to one another on said circular band (28).

12. The production plant according to claim 11, wherein the individual pushing members (44) are offset relative to the carriers in the direction of transport of the small packs (32) to such a degree, that the individual pushing members (44) are movable past said carriers (31) when said pushing device (35; 35*a*, 35*b*) is actuated.

13. The production plant according to claim 1, further comprising tape-applying means (26), disposed between said reservoir means (27) and said stacker machine (23), for affixing to each small pack (32) and adhesive tape for use as a tear-open aid.

14. The production plant according to claim 2 or 3, wherein a horizontally extending further portion (28*b*) of said circular band (28) follows the at least approximately vertically extending band portion (28*a*).

15. The production plant according to claim 2 or 3, wherein a vertically extending further portion (28*c*) of said circular band (28) follows the at least approximately vertically extending band portion (28*a*) via a deflecting roller (30*b*).

* * * * *